United States Patent [19]

Jaworowski et al.

[11] 4,238,203

[45] Dec. 9, 1980

[54] METHOD OF ENHANCING THE EFFECTIVENESS OF ELECTROSTATIC PRECIPITATORS USED WITH GAS STREAMS FORMED FROM BURNING FUEL

[75] Inventors: Raymond Jaworowski, Convent Station, N.J.; Eric Darmstaedter, Dallas, Tex.; Cliff D. Barton, Mountain Lakes, N.J.; William Taylor, Tyler, Tex.

[73] Assignee: Apollo Technologies, Inc., Whippany, N.J.

[21] Appl. No.: 48,521

[22] Filed: Jun. 14, 1979

[51] Int. Cl.[3] ..... B03C 3/00

[52] U.S. Cl. ..... 55/5; 55/11; 55/139

[58] Field of Search ..... 55/5, 133, 139, 11, 55/136–138, 139; 307/17, 29, 30, 38

[56] References Cited

U.S. PATENT DOCUMENTS

| | | | |
|---|---|---|---|
| 3,960,687 | 6/1976 | Bakke et al. | 55/5 |
| 4,042,348 | 8/1977 | Bennett et al. | 55/5 |
| 4,043,768 | 8/1977 | Bennett et al. | 55/5 |
| 4,097,252 | 6/1978 | Kirchoff et al. | 55/136 |
| 4,113,447 | 9/1978 | Bennett et al. | 55/5 |

FOREIGN PATENT DOCUMENTS

| | | | |
|---|---|---|---|
| 2727973 | of 1978 | Fed. Rep. of Germany | 55/5 |
| 1539344 | 1/1979 | United Kingdom | 55/136 |

*Primary Examiner*—Bernard Nozick

*Attorney, Agent, or Firm*—James & Franklin

[57] ABSTRACT

The effectiveness of electrostatic precipitators, and particularly existing electrostatic precipitator installations, is enhanced by introducing into the gas stream in advance of the precipitator a spark-inhibiting additive, and then increasing the voltage applied to the precipitator over that which otherwise could be applied. The spark-inhibiting additive is preferably an ammonium salt introduced into the gas stream at a relatively low temperature and preferably in combination with the introduction into the gas stream at a relatively higher temperature of known conditioning additives from the group consisting of sodium bisulphate, ammonium bisulphate, ammonium sulphate and mixtures thereof. An existing installation in which, typically, a single power source energizes a plurality of precipitator cells because of the limiting nature of the sparking characteristics then operative, through the use of this method can be converted to an installation having a marked increase in precipitator efficiency without any additional capital investment other than providing an increased number of power sources so that all or a substantial number of the precipitator cells are provided with individual power sources.

14 Claims, 2 Drawing Figures

Figure 1:
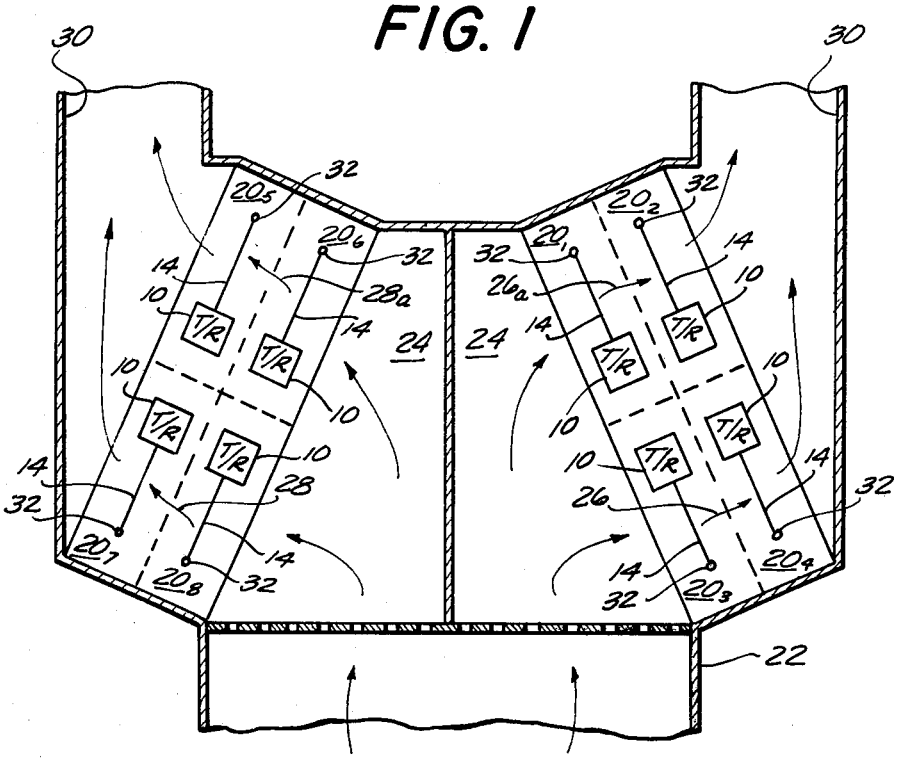

METHOD OF ENHANCING THE EFFECTIVENESS OF ELECTROSTATIC PRECIPITATORS USED WITH GAS STREAMS FORMED FROM BURNING FUEL

The present invention relates to a method for enhancing the precipitation effectiveness of an electrostatic precipitator installation used in conjunction with a gas stream formed from burning fuel such as coal, and has particular utility in upgrading existing installations while using essentially the same capital equipment.

The use of electrical precipitators for the collection and removal of particulate material from a gas stream formed from the burning of fuel such as coal is quite common. Indeed, in these days of enhanced sensitivity to ecological conditions, their use in connection with power generation plants, and particularly those involving the burning of coal, is extremely prevalent. Such precipitators are commonly provided in the form of cells through which the gas stream is caused to flow. Those cells contain separated electrodes between which a relatively high voltage is applied, that voltage setting up an electrical field and a corona discharge which tends to cause the particles entrained in the gas flow to precipitate or deposit on collecting electrodes or plates, thus removing those precipitated particles from the gas stream. The particles are removed from the system in any manner appropriate to their physical state, but they are not spewed out from the stack, and hence the atmosphere is not polluted by those particles.

Although such precipitators have long been used, their efficiency in removing particles from the gas stream has not been optimum. In particular, the action of electrostatic precipitators has not been able to keep pace with increasingly severe ecological requirements. Accordingly, much study has been given to improving the operation of these precipitators. The main approach—and it has been a quite effective approach—has been to add certain conditioning materials to the flue gas in order to modify the characteristics of the dust particles, particularly with respect to electrical resistance. Bennett et al. U.S. Pat. No. 4,042,348 of Aug. 16, 1977, Bennett et al. U.S. Pat. No. 4,043,768 of Aug. 23, 1977, and Bennett et al. U.S. Pat. No. 4,113,447 of Sept. 12, 1978, all assigned to the assignee of this application, and patents and other references cited therein, relate to that approach. In particular, those three Bennett et al. patents teach the use of ammonium sulphate or ammonium bisulphate introduced into flue gas at a temperature of 590°-900° C. and sodium bisulphate introduced into flue gas at a temperature of 200°-900° C., the additives being introduced into the gas stream upstream of the heat exchange means. These additives have been particularly effective in reducing particulate emissions from power generating plants, and have in many instances enabled plants to meet Government-set emission standards where procedures used without those additives have been ineffective to meet those standards.

However, there have been instances when those additives, no matter how wisely used, have been unable in and of themselves to cause a given power generating plant using a particular grade of fuel to meet the Government requirement for emission, particularly but not exclusively in connection with opacity.

One answer to such a problem is to simply add precipitator cells, or to discard the existing precipitator cells and re-build the plant with other larger and more expensive precipitator cells. This is, of course, an extremely costly proceeding, involving a massive capital outlay. Moreover, to carry out such a plan involves deactivating the generating system for a very substantial period of time, something that may simply not be practical when demand for electrical power is as high as it is.

It has been found, in accordance with the present invention, that existing electrostatic precipitator installations can be upgraded to provide substantially more effective particle precipitation by approaching the problem not solely from the point of view of modifying the electrical characteristics of the particulate matter itself, as in the prior art, but from a different direction, to wit, by so modifying the entire gas-stream precipitator complex as to inhibit the tendency of that complex to form sparks. This enables one to apply to the precipitator a considerably higher voltage than had previously been applied thereto, and that in turn enables the precipitator to perform its desired functions more effectively.

The fact that an electrostatic precipitator functions more effectively the greater the voltage applied thereto has long been known, but it has likewise long been known that the voltage that can be applied is limited, in part by the precipitator design and in part by the nature and amount of particulate matter precipitated, to a voltage below that at which significant sparking occurs. The thrust of the present invention is to increase the voltage at which sparking occurs by adding appropriate spark-inhibiting materials to the flue gas, and by then providing increased voltage and power to the precipitator cells. It has been found that when the spark-inhibiting additive is an ammonium salt, and in particular is a member of the group consisting of ammonium sulphate, ammonium bisulphate, diammonium phosphate and mixtures thereof, and especially when that additive is used in conjunction with one of the particle-conditioning agents of the Bennett et al. patents cited above, significantly improved precipitator action ensues.

It is well known that an electrostatic precipitator must be designed with certain fuel characteristics in mind. Among these are the ash concentration, the sulfur level, the resistivity of the ash and the anticipated electrical response of that ash. In addition, the effect of possible changes in the allowable current density due to changes in the material being collected (arising, for example, from a change in a type of coal burned) must be taken into account. If the fuel involved may give rise to reduced current densities, that will reduce collection efficiency, and hence the precipitator should be designed with a greater collection plate area, but that excess plate area will be superfluous when fuels are burned which permit greater current density. Moreover, a greater mass of precipitated particles will exit the precipitator due to rapping reentrainment for lower values of current density than for higher values thereof, and the mass that exits the precipitator will also affect the voltage values at which sparking will take place.

In many instances the useful operating current density in a precipitator is limited by the resistivity of the collected particulate layer. If the resistivity of the collected particulate layer is sufficiently high, electrical breakdown of the layer will occur at a value of current density which in most cases is undesirably low. Depending upon the value of the applied voltage, the breakdown of the collected particulate layer will result in either a condition of sparking or the formation of stable back-corona from points on the particulate layer.

Based upon these and other considerations, a certain power level is designed into the precipitator, seeking to utilize the highest useful values of applied voltage and current density for the following reasons:

1. High applied voltages produce high electric fields.
2. High electric fields produce high values of the saturation and limiting charge that a particle may obtain.
3. High current densities produce high rates at which particles charge to the saturation or limiting values of charge.
4. High current densities produce an increased electric field near the collection electrode due to the "ionic space charge" contribution to the field.
5. High values of electric field and particle charge produce high migration velocities and increased transport of particles to the collection electrode.

However, one cannot merely add voltage and/or current density to a precipitator. The electrical conditions in a precipitator are limited by either electrical breakdown of the gas in the interelectrode space or by electrical breakdown of the gas in the collected particulate layer. In a clean gas, clean plate environment, gas breakdown can originate at the collection electrode due to the surface irregularities and edge effects which result in localized regions of high electric field. If the electric field in the interelectrode space is high enough, the gas breakdown will be evidenced by a spark which propagates across the interelectrode space, the operating applied voltage and current density will be limited by these sparking conditions.

If a particulate layer is deposited on the collection electrode, as will be the case in the operation of an electrostatic precipitator, then the corona current must pass through the particulate layer to the grounded collection electrode. The average electric field in the particulate layer can be increased to the point that the gas in the interstitial space breaks down electrically. This breakdown results from the acceleration of free electrons to ionization velocity to produce an avalanche condition similar to that at the corona electrode. When this bread-down occurs one of two possible situations will ensue:

1. If the electrical resistivity of the particular layer is moderate, then the applied voltage may be sufficiently high so that a spark will propagate may be sufficiently high so that a spark will propagate across the interelectrode space. The rate of sparking for a given precipitator geometry will determine the operating electrical conditions in such a circumstance.

2. If the electrical resistivity of the particular layer is high, then the applied voltage may not be high enough to cause a spark to propagate across the interelectrode space. In this case the particulate layer will be continuously broken down electrically and will discharge positive ions into the interelectrode space. This condition is called back-corona. The effect of these positive ions is to reduce the amount of negative charge on a particle due to bipolar charging and reduce the electric field associated with the "ionic space charge". Both the magnitude of particle charge and rate of particle charging are affected by back-corona. Useful precipitator current is, therefore, limited to values which occur prior to electrical breakdown whether the breakdown occurs as sparkover or back-corona. For purposes of simplicity, the term "sparking" is here used to include either or both of sparkover and back-corona.

In practice it is desirable to operate a precipitator at the highest values of applied voltage and current density that can be obtained without excessive sparking or back corona. Higher values of applied voltage lead to higher electric fields which result in increased particle charge and a higher value of the electric field near the collection electrode. Higher values of current density lead to higher ion densities which result in faster charging rates and an increased contribution to the total electric field near the collection electrode due to space charge. Thus, higher values of applied voltage and current density lead to higher migration velocities and higher collection efficiencies. However, as we have seen, the values of applied voltage and current density which can be applied are limited by the onset of sparking or back-corona.

There is no question but that excessive sparking is detrimental to precipitator performance and should be avoided. Power consumed in precipitator sparking represents a waste of electrical energy. Also, sparking limits the maximum voltage that can be applied between the precipitator plates, and that in turn directly adversely affects the magnitude of the precipitating effect. Hence, sparking is a limiting factor insofar as precipitator operation is concerned. The higher the resistivity of the particles entrained in the flue gas the greater is the problem presented by sparking, because high resistivity particles produce a greater tendency towards sparking and require the use of relatively low corona current densities. Each precipitator spark, if and when it occurs, disturbs electrical operation and reduces collection efficiency. Optimum conditions will be achieved when the spark intensity and frequency is low and the duration of the spark no more than one or two cycles of the AC power input.

Among the options heretofore considered for solving these precipitator problems, particularly in connection with high resistivity ash, is the addition of a retrofit precipitator to the unit. This has the drawback of involving design criteria for determining the size and power factors for the new portion. This process is very expensive and involves a long lead time. Additionally, a retrofit precipitator has substantial space requirements that are often difficult to meet when adding on to an existing unit. A relatively new technique which is currently being investigated on an experimental scale is the use of a pre-ionizer. This, in effect, divides the precipitator into a two-part system, one for ionizing and one for collecting. This is not currently commercially available for a full size precipitator and will still suffer the problems of a retrofit in that substantial lead time is necessary for manufacture and installation, and a certain amount of real estate will be necessary in order to install the pre-ionizer onto an existing unit.

It has been found that the combination of specific chemical conditioning active to reduce the tendency of the precipitator to spark, or stated otherwise, to raise the voltage at which sparking (spark over and/or back-corona) will occur, together with the addition of transformer/rectifiers or other power sources to a given installation, preferably so that all or a substantial number of the individual precipitator cells have their own individual power sources, improves the performance of the precipitators significantly in excess of what either one of those approaches would do by itself. With this combination approach a given power plant installation can meet emission requirements without having to install new or additional precipitators. In particular, this procedure is especially effective when used in conjunction with the type of flue gas conditioning which is the subject of the previously cited Bennett et al. patents.

While the method here disclosed has particular applicability to the upgrading of preexisting installations, use of the method is also valuable in designing new installations by permitting the precipitators for such installations to be designed to produce maximum precipitation results with minimum cost and size.

It is therefore a prime object of the present invention to provide a method which will improve the emission control of existing installations beyond what heretofore has been thought feasible, and to do this without requiring any substantial capital investment or any subsantial disruption of the operation of the installation.

A further object of the present invention is to provide a combined chemical and electrical approach to the operation of electrostatic precipitators which will enable such precipitators to be designed to be more effective and more economical than has previously been the case.

A further object of the present invention is to enhance the effectiveness of prior art flue gas chemical conditioners of the type designed to modify the electrical characteristics of the particulate matter in the flue gas.

Figure 2:
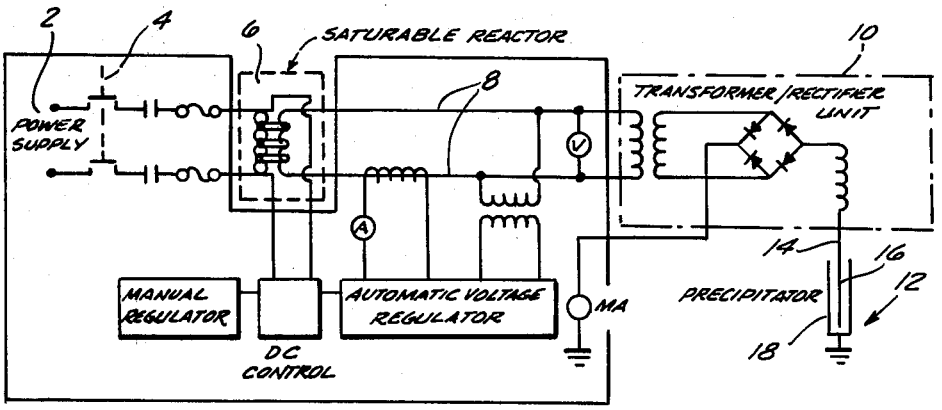

To the accomplishment of the above, and to such other objects as may hereinafter appear, the present invention relates to a method of improving the action of electrostatic precipitators as defined in the appended claims and as described in this specification, taken together with the accompanying drawings in which FIG. 1 is a schematic representation of an eight-cell electrostatic precipitator, showing the relationship between power sources and cells; and FIG. 2 is a circuit diagram of a typical powering arrangement for an electrostatic precipitator.

Electrostatic precipitators utilize a corona discharge to charge the particles passing through an electrical field established by a plurality of discharge electrode wires suspended by insulators in a plane parallel to a grounded collecting electrode plate. The charged particles are attracted to the collector plate from which they may then be removed by vibrating or rapping the plate. Examples of this type of precipitator are found in U.S. Pat. Nos. 3,109,720 and 3,030,753. The power and voltage for producing that corona discharge comes from an appropriate powering source, a typical such source being shown in FIG. 2. Power from an external power supply 2 is fed by switch 4 to a saturable reactor 6 located at some appropriate remote spot in the plant. Leads 8 feed the output of the saturable reactor 6 to a plurality of transformer/rectifier units generally designated 10 located adjacent the precipitator cells schematically indicated as 12. The high voltage output from the transformer/rectifier unit 10 is fed by lead 14 to the discharge electrode wires 16 within the precipitator cells, those wires 16 being spaced from the grounded collecting electrode plates 18. In the individual precipitator cells, a plurality of which are diagrammatically indicated in FIG. 1, the discharge wires 16 and the collecting plates 18 are arranged in rows spaced from one another, and the flue gas flows through those spaces.

FIG. 1 illustrates diagrammatically a typical arrangement involving eight precipitator cells 20. It will be appreciated that this schematic illustration is but typical, and that in a given system many different numbers of precipitator cells may be employed, in many different arrangements. In the particular arrangement here selected for explanatory purposes, the eight precipitator cells, designated $\mathbf{20}_1$, $\mathbf{20}_2$, $\mathbf{20}_3$ $\mathbf{20}_4$, $\mathbf{20}_5$, $\mathbf{20}_6$, $\mathbf{20}_7$, and $\mathbf{20}_8$, are arranged in two groups of four cells each. The flue gas flows through conduit 22 into space 24 between the two sets of precipitator cells $\mathbf{20}_1$–$\mathbf{20}_4$ and $\mathbf{20}_5$–$\mathbf{20}_8$ respectively. In each set of cells the four cells are arranged to define two parallel paths of flow, as indicated by the arrows 26 and **26*a* for one set of cells and the arrows 28 and 28*a* for the other set of cells, each arrow 26, 26*a*, 28 and 28*a* representing flow of gas through two cells in series. The flue gas, after it passes through one or the other of the sets of cells, passes on through flues 30 and eventually flows to the stack. Mounted on or adjacent to each of the sets of four precipitator cells are four transformer/rectifier units 10, each electrically connected by a lead 14 to a bushing 32 which is in turn electrically connected to the corona wires 16** within a given precipitator cell.

It will be noted that, as shown in FIG. 1, each of the four precipitator cells 20 of a given assembly has its own transformer/rectifier unit 10. In a normal prior art installation encountered in the field, the limitations on power and voltage imposed by the sparking conditions which come to exist in the individual precipitator cells commonly leads to the sharing of a given transformer/-rectifier unit 10 between two cells. This is so because the sparking conditions which existed so limited the amount of voltage and power that could properly be applied to any one cell that commercially available transformer/rectifier units 10 had the capacity to supply two cells at the same time, and it was more economical to provide one transformer/rectifier unit capable of powering two cells than to provide smaller individual transformer/rectifier units for each cell. In other words, for a given electrostatic precipitator design, and particularly when such precipitators were used with high resistivity ash, the degree to which power and voltage could be fed to a given precipitator cell without causing sparking was so inhibiting to the amount of power that could be effectively applied to a given cell for precipitation purposes, that one commercially available power source could power more than one precipitator cell.

In one such installation encountered in the field, where a given transformer/rectifier unit power two precipitator cells, the action of the precipitator itself was insufficient to enable particulate emissions to comply with environmental regulations. That installation had a 575 megawatt balanced draft boiler with two Ljungstrom air heaters and was equipped with a Research-Cottrell electrostatic precipitator designed for 97% efficiency based on the analysis of core samples of the lignite to be burned. The system had eight transformer/rectifier units powering sixteen precipitator cells. After the boiler was put into operation, particle emissions were found to be out of compliance with environmental regulations for both mass and opacity limits.

TABLE I

| Test | Load (MW) | Coal (MTPH) | Total ESP Power (KVA) | T/R Sets (No.) | Emission (Kg/hr) | Opacity (%) | $NaHSO_4$[a] (grams per metric ton) | $(NH_4)_2SO_4$[b] (grams per metric ton) |
|---|---|---|---|---|---|---|---|---|
| 1 | 564 | 380 | 292 | 8 | 1224 | 45 | 0 | 0 |
| 2 | 567 | 365 | 639 | 8 | 384 | 30 | 398 | 0 |
| 3 | 564 | 375 | 625 | 8 | — | 30 | 398 | 103 |
| 4 | 565 | 356 | 615 | 8 | 390 | 26 | 398 | 0 |
| 5 | 566 | 367 | 1033 | 15* | 209–193 | 17 | 398 | 103 |
| 6 | 564 | 368 | 420 | 15* | 720 | 39 | 0 | 103 |
| 7 | 566 | 371 | 652 | 15* | 372 | 30 | 398 | 0 |
| 8 | 564 | 375 | 935 | 12 | — | 24 | 339 | 51 |

*outlet 1—1 with single T/R only
T/R stands for Transformer/Rectifier
[a]$NaHSO_4$ injected as an aqueous solution at 725° C.
[b]$(NH_4)_2SO_4$ injected as an aqueous solution at 193° C.

The first approach was to use a chemical conditioner according to the teachings of the Bennett et al. patents cited above. As shown by Table 1, Test 2, the addition of sodium bisulphate in accordance with the teachings of U.S. Pat. No. 4,113,447 resulted in a significant decrease in emissions, from 1224 kg/hr. to 384 kg/hr., but a reduction in opacity from 45% only to 30%. This opacity figure did not meet requirements. Another test (Test 4 of Table 1) gave substantially the same results.

Another test was carried out (Test 3) in which, in addition to adding the sodium bisulphate in accordance with the teachings of the Bennett '447 patent, ammonium sulphate was injected into the flue gas as an aqueous solution at a relatively cooler place in the flue gas flow, after the air heater but before the precipitator, but essentially the same power was applied to the precipitator and no change was made in electrical arrangement. This had no measurable effect on opacity (data was not taken on emission).

When, however, the power applied to the precipitator was greatly increased, by connecting individual transformer/rectifier units, of the type then existing in that installation, individually to substantially all of the precipitator cells (by utilizing transformer/rectifier units that were already at the plant but temporarily available because located on a separate installation then off line), and the ammonium sulphate was added as before, there was not only a very substantial reduction in emission of 209–293 kg/hr., but also a very significant decrease in opacity to 17% (Test 5).

To check the results, with the same electrostatic cell powering, Tests 6 and 7 were run, Test 6 utilizing only the ammonium sulphate injected at a low temperature and Test 7 utilizing only the sodium bisulphate injected at a high temperature. In Test 6 both emission and opacity were worse than when only sodium bisulphate was employed, and in Test 7 the results were essentially the same as in Test 2 despite the difference in electric powering of the cells.

In Test 8 both the sodium sulphate introduced in accordance with the Bennett '447 patent and the ammonium sulphate introduced at a lower temperature were employed, but with only approximately one-half the amount of ammonium sulphate as compared with Test 5, and with only twelve transformer/rectifier sets being used instead of fifteen. The effect was to provide improved opacity when compared with the use of no ammonium sulphate but not as much improvement in opacity as when more ammonium sulphate and more transformer/rectifier sets were employed.

One may note from the test data that the additional feed of ammonium sulphate at a relatively low temperature did not in and of itself lower the opacity (compare Tests 3 and 6 with Test 2) but that when using either fifteen or twelve transformer/rectifier units rather than eight such units, both the opacity and mass emissions were significantly reduced when ammonium sulphate was fed to control sparking (Tests 5 and 8 as compared with Test 4). Moreover, the limiting effect of a high spark rate on the ability to put extra power into the unit is shown by comparing Tests 2 and 4 with Test 7. In Test 7, even though fifteen transformer/rectifier sets are employed, the total precipitator power is not appreciably increased. Precipitator power fell off in Test 6 because no particle conditioning agent, such as sodium bisulphate, was employed. It is Tests 5 and 8 which reflect the increased efficiency involved in using a spark-inhibiting agent and increasing the powering of the precipitator cells.

The ammonium sulphate performs a spark-inhibiting function. Ammonium salts in general, and in particular, in addition to ammonium sulphate, ammonium bisulphate, diammonium phosphate and mixtures thereof, will accomplish this result. These ammonium salts are introduced into the flue gas preferably at a relatively low temperature, preferably in a range of 100°–300° C. This is to be contrasted with the temperature range of 590°–900° C. described in Bennett et al. U.S. Pat. No. 4,043,768. As pointed out in that patent the injection of ammonium sulphate there is at a temperature sufficiently high to insure substantial decomposition of the ammonium sulphate prior to contact of the ammonium sulphate with the air preheater means or any other heat exchange unit which the ammonium sulphate might deposit upon and/or clog, and it is pointed out that it is essential in practising the teachings of that patent that the ammonium sulphate decompose prior to its contact with the precipitator. For the purposes of the present invention, however, where the effect of the salt on sparking is involved, such decomposition is not at all necessary, and, indeed, may well be undesirable.

The amount of ammonium sulphate injected for spark control, preferably from 500 to 100 grams per metric ton of fuel burned, while slightly overlapping the range of 75–1250 grams per metric ton of fuel burned in connection with the broad teachings of the Bennett '767 patent, is well below the preferred range there taught.

It is preferred to introduce the ammonium sulphate or other ammonium salts into the gas stream after the air heater because, as is pointed out in the Bennett '767 patent while discussing U.S. Pat. No. 3,665,676, introduction of ammonium sulphate or other ammonium salts before the air heater and at temperatures such that decomposition does not take place tends to clog the air heater. In connection with consideration of U.S. Pat.

No. 3,665,676, it must be borne in mind that the action of ammonium sulphate in modifying the resistivity of the particulate matter is relatively slight when the salt is added at temperatures below decomposition, and hence relatively large amounts of that substance must be used to chemically condition the particles to any appreciable extent in accordance with the teachings of the '676 patent. In accordance with the instant invention, however, where the salt is used to inhibit sparking, and is used in conjunction with increasing the power applied to the precipitator cells so that they function more efficiently, only relatively small amounts of salt need be employed.

Although in the tests described the specific particle conditioner used was sodium bisulphate, as taught in Bennett et al. U.S. Pat. No. 4,113,447, one may also use for particle conditioning purposes the substances and methods disclosed in the other two cited Bennett et al. patents, involving ammonium sulphate and ammonium bisulphate respectively. The texts of all three of those Bennett et al. patents are incorporated here by reference.

In the exemplary field procedure described above there were originally 8 precipitating cells and 4 power sources. This can be expressed generally as x cells and y power sources. In accordance with the present invention, and as described, the number of power sources was increased to 8, so that each cell had its own power source. This can be expressed generally as increasing the number of power sources by z. Since the maximum increase is to have one power source for each cell, a maximum value for z is x-y, so z must be less than $x-y+1$; to have any increase of power sources at all z must be greater than 0. Thus in the exemplary field procedure $x=8$, $y=4$ and $z=4$. Thus the procedure can be expressed generally as starting with x precipitating cells and y electric power sources, where x is greater than y, and increasing the number of electric power sources $y+z$, where z is greater than 0 and less than $x-y+1$.

While but a limited number of embodiments of the present invention have been here specifically disclosed, it will be apparent that many variations may be made therein, all within the scope of the invention as defined in the following claims.

We claim:

1. Method of improving the action of electrostatic precipitators in separating particulate matter from a gas stream formed from burning fuel in pre-existing installations having x precipitating cells and y electric power sources of given voltage capacity electrically connected to said cells for energizing them, where x is greater than y, said power sources being operated at voltage levels such as to cause the voltage level applied thereby to each cell associated therewith to be at a first value below that which would cause excessive sparking upon operation of said cell in pre-existing manner, which method comprises:

(a) forming a first mixture of the particle-laden gas at a temperature of 590°–900° C. with a conditioning agent from the group consisting of sodium bisulphate, ammonium sulphate, ammonium bisulphate and mixtures thereof, said mixture containing 75–1250 grams of conditioning agent per metric ton of fuel burned;

(b) at a temperature of about 100°–300° C., and in advance of said cells, forming a second mixture of said first mixture of conditioned gas with a spark-inhibiting ammonium salt; and (c) increasing the number of electric power sources of said given voltage capacity to $y+z$, where z is greater than 0 and less than $x-y+1$, so connecting said sources to said cells as to substantially maximize the number of said cells that have individual power sources, and operating said power sources at voltage levels such as to cause the voltage level applied thereby to each cell associated therewith to be at a second value above said first value, said second value being one which, in the absence of said spark-inhibiting additive, would cause excessive sparking but which is insufficient to cause excessive sparking in the presence of said spark inhibiting chemical, whereby additional voltage is applied to each said cell without causing excessive sparking.

2. The method of claim 1, in which said spark-inhibiting additive is added in an amount between about 50–100 grams per metric ton of fuel burned.

3. The method of claim 1, in which said installation comprises an air heater and in which said spark-inhibiting additive is mixed with said gas stream downstream of said air heater.

4. The method of claim 1 in which $x \cong 2y$, $z \cong y$, substantially each cell in said pre-existing installation shares a power source with another cell, said method comprises providing for substantially each cell its own individual power source.

5. The method of claim 4, in which said spark-inhibiting additive is a member of the group consisting of ammonium sulphate, ammonium bisulphate, diammonium phosphate and mixtures thereof.

6. The method of claim 1, in which said spark-inhibiting additive is added to said gas stream when said stream is at a temperature of approximately 100° C.

7. The method of claim 6, in which said spark-inhibiting additive is a member of the group consisting of ammonium sulphate, ammonium bisulphate, diammonium phosphate and mixtures thereof.

8. The method of claim 1, in which said spark-inhibiting additive is a member of the group consisting of ammonium sulphate, ammonium bisulphate, diammonium phosphate and mixtures thereof.

9. The method of claim 8, in which said spark-inhibiting additive is added in an amount between about 50–100 grams per metric ton of fuel burned.

10. A method of improving the collection characteristics of particles entrained in a stream of particle-laden gas formed by the burning of fuel for collection by an electrostatic precipitator having a plurality of precipitator cells, which comprises:

(a) at a first point in said stream flow forming a first mixture of the particle-laden gas at a temperature of 590°–900° C. with a conditioning agent from the group consisting of sodium bisulphate, ammonium sulphate, ammonium bisulphate and mixtures thereof, said mixture containing 75–1250 grams of conditioning agent per metric ton of fuel burned, and first mixture having the characteristic of giving rise to excessive sparking unless said precipitator cells are energized below a first value of voltage;

(b) at a second point in said stream flow downstream of said first point and at a temperature of about 100°–300° C. forming a second mixture of said first mixture of conditioned gas with a spark-inhibiting ammonium salt;

(c) directing said gas stream through a heat exchange means located downstream of said first point and then into said precipitator cells which are located downstream of said second point; and (d) energizing said precipitator cells at a second voltage value greater than said first value, said second value being that which brings said second mixture to a point below but close to the point where excessive sparking of said second mixture would occur.

11. The method of claim 10, in which said spark-inhibiting additive is added in an amount between about 50–100 grams per metric ton of fuel burned.

12. The method of claim 10, in which said spark-inhibiting additive is added to said gas stream when said stream is at a temperature of approximately 100° C.

13. The method of claim 12, in which said spark inhibiting additive is a member of the group consisting of ammonium sulphate, ammonium bisulphate, diammonium phosphate and mixtures thereof.

14. The method of claim 12, in which said spark inhibiting additive is added in an amount between about 50–100 grams per metric ton of fuel burned.

* * * * *

Disclaimer 4,238,203.—*Raymond Jaworowski,* Convent Station, N.J.; *Eric Darmstaedter,* Dallas, Tex.; *Cliff D. Barton,* Mountain Lakes, N.J.; and *William Taylor,* Tyler, Tex. METHOD OF ENHANCING THE EFFECTIVENESS OF ELECTROSTATIC PRECIPITATORS USED WITH GAS STREAMS FORMED FROM BURNING FUEL. Patent dated Dec. 9, 1980. Disclaimer filed Mar. 10, 1983, by the assignee, *Economics Laboratory, Inc.*

Hereby enters this disclaimer to all claims of said patent.

[*Official Gazette May 10, 1983.*]